US009315883B2

(12) United States Patent
Liu et al.

(10) Patent No.: US 9,315,883 B2
(45) Date of Patent: Apr. 19, 2016

(54) HIGH STRENGTH AND LOW DENSITY PARTICLE-REINFORCED STEEL WITH IMPROVED E-MODULUS AND METHOD FOR PRODUCING SAID STEEL

(71) Applicant: TATA STEEL NEDERLAND TECHNOLOGY BV, Velsen-Noord (NL)

(72) Inventors: Cheng Liu, Velserbroek (NL); Christian Theodorus Wilhelmus Lahaye, Heerhugowaard (NL)

(73) Assignee: TATA STEEL NEDERLAND TECHNOLOGY BV, Velsen-Noord (NL)

( * ) Notice: Subject to any disclaimer, the term of this patent is extended or adjusted under 35 U.S.C. 154(b) by 0 days.

(21) Appl. No.: 14/428,194

(22) PCT Filed: Sep. 13, 2013

(86) PCT No.: PCT/EP2013/069047

§ 371 (c)(1),
(2) Date: Mar. 13, 2015

(87) PCT Pub. No.: WO2014/041136

PCT Pub. Date: Mar. 20, 2014

(65) Prior Publication Data

US 2015/0247223 A1 Sep. 3, 2015

(30) Foreign Application Priority Data

Sep. 14, 2012 (EP) ..... 12184460

(51) Int. Cl.
*C22C 38/06* (2006.01)
*C22C 38/14* (2006.01)

(Continued)

(52) U.S. Cl.
CPC ..... *C22C 38/06* (2013.01); *B22D 11/001* (2013.01); *B22D 11/12* (2013.01); *C21D 1/26* (2013.01);

(Continued)

(58) Field of Classification Search
CPC .... C22C 38/00; C22C 38/001; C22C 38/002; C22C 38/004; C22C 38/02; C22C 38/04; C22C 38/06; C22C 38/08; C22C 38/12; C22C 38/14; C22C 38/16; C22C 38/18; C22C 38/20; C22C 38/22; C22C 38/24; C22C 38/26; C22C 38/28; C22C 38/32; C22C 38/40; C22C 38/42; C22C 38/44; C22C 38/46; C22C 38/48; C22C 38/50; C22C 38/54; C22C 38/58
See application file for complete search history.

(56) References Cited

U.S. PATENT DOCUMENTS 2,295,706 A * 9/1942 Comstock ..... C21C 7/06 420/581
6,383,662 B1 5/2002 Frommeyer (Continued)

FOREIGN PATENT DOCUMENTS

EP 1897963 A1 3/2008
JP 2002105588 A 4/2002

(Continued)

OTHER PUBLICATIONS

ASM International Handbook Committee. (1990). ASM Handbook, vol. 01—Properties and Selection: Irons, Steels, and High-Performance Alloys. pp. 115-125.*

(Continued)

*Primary Examiner* — Roy King
*Assistant Examiner* — Jophy S Koshy
(74) *Attorney, Agent, or Firm* — Vorys, Sater, Seymour and Pease LLP

(57) ABSTRACT

A particle-reinforced high strength and low density steel with improved E-modulus and method for producing the steel.

24 Claims, 3 Drawing Sheets

Figure 1:
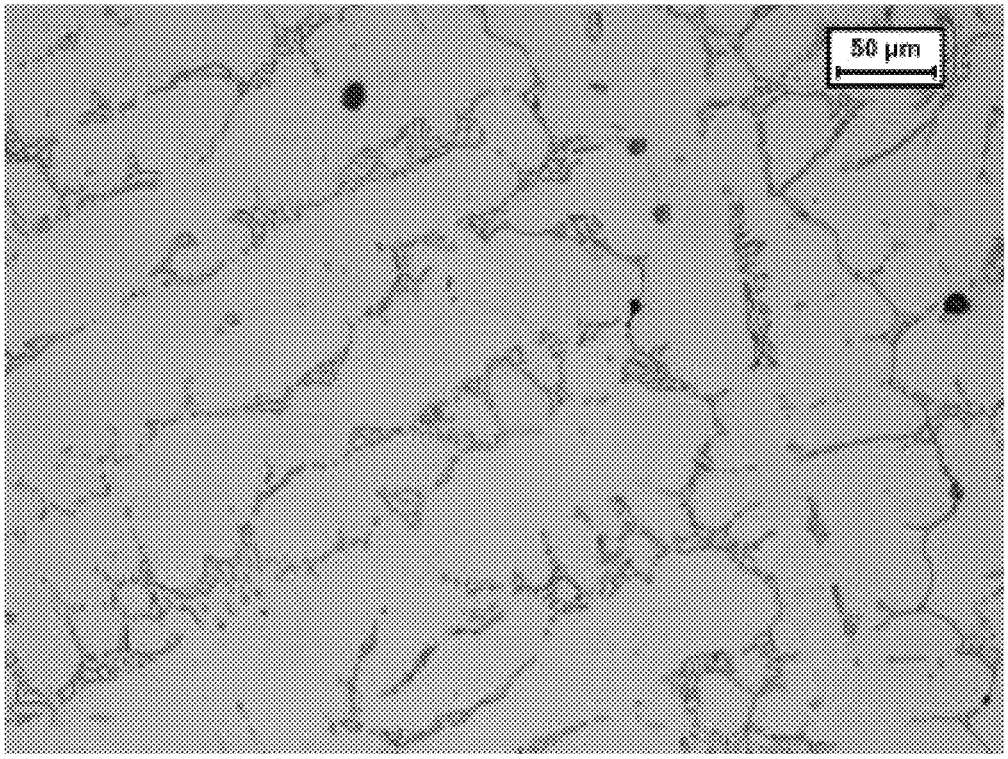
Figure 2:
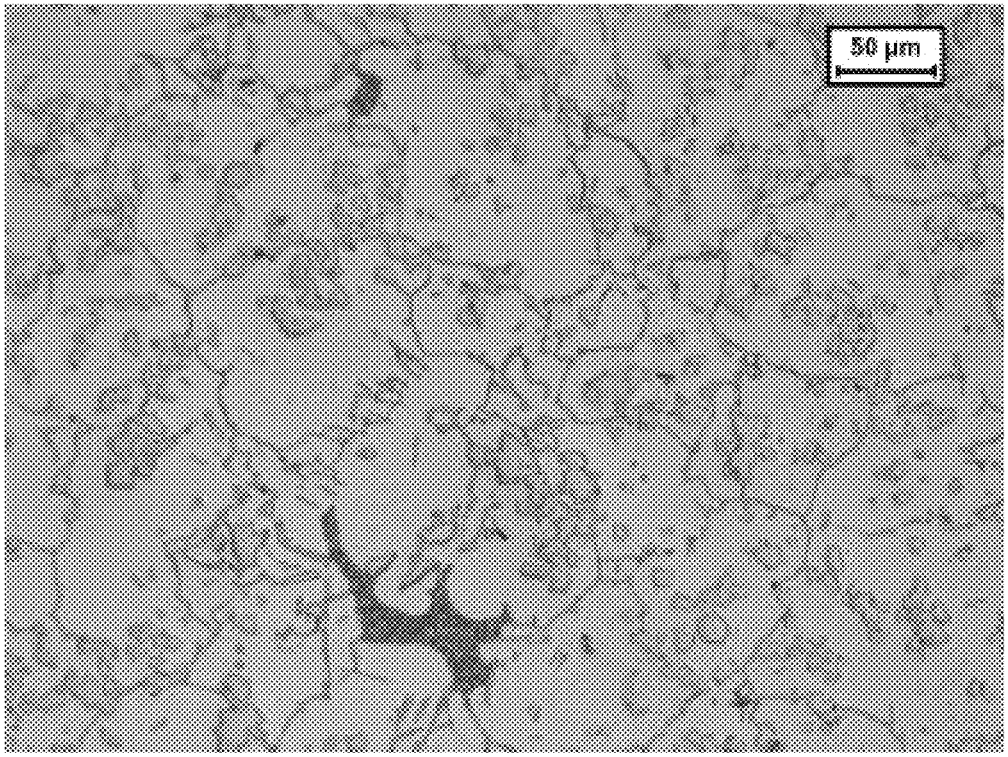

(51) Int. Cl.

| | |
|---|---|
| ***B22D 11/00*** | (2006.01) |
| ***B22D 11/12*** | (2006.01) |
| ***C21D 1/26*** | (2006.01) |
| ***C21D 6/00*** | (2006.01) |
| ***C21D 8/02*** | (2006.01) |
| ***C21D 9/00*** | (2006.01) |
| ***C21D 9/52*** | (2006.01) |
| ***C22C 38/00*** | (2006.01) |
| ***C22C 38/02*** | (2006.01) |
| ***C22C 38/04*** | (2006.01) |
| ***C23C 2/02*** | (2006.01) |
| ***C23C 2/40*** | (2006.01) |
| ***C25D 5/36*** | (2006.01) |
| ***C25D 7/00*** | (2006.01) |

(52) U.S. Cl.

CPC ..... *C21D 6/005* (2013.01); *C21D 6/008* (2013.01); *C21D 8/0226* (2013.01); *C21D 8/0236* (2013.01); *C21D 8/0263* (2013.01); *C21D 9/0081* (2013.01); *C21D 9/52* (2013.01); *C22C 38/001* (2013.01); *C22C 38/002* (2013.01); *C22C 38/004* (2013.01); *C22C 38/02* (2013.01); *C22C 38/04* (2013.01); *C22C 38/14* (2013.01); *C23C 2/02* (2013.01); *C23C 2/40* (2013.01); *C25D 5/36* (2013.01); *C25D 7/00* (2013.01)

(56) References Cited

U.S. PATENT DOCUMENTS

| | | | |
|---|---|---|---|
| 2010/0033585 | A1 | 2/2010 | Ye |
| 2010/0300585 | A1 | 12/2010 | Perlade et al. |
| 2013/0174942 | A1 | 7/2013 | Bonnet et al. |

FOREIGN PATENT DOCUMENTS

| | | | |
|---|---|---|---|
| JP | 2004035948 | A | 2/2004 |
| JP | 2007051341 | A | 3/2007 |
| WO | 2014040783 | A1 | 3/2014 |

OTHER PUBLICATIONS

Written Opinion of the International Searching Authority dated Nov. 22, 2013 from International Application PCT/EP2013/069047 to Tata Steel Nederland Technology BV filed Sep. 13, 2013.

Jiang Q C et al: "Fabrication of steel matrix composites locally reinforced with in situ TiB2—TiC particulates using self-propagating high-temperature synthesis reaction of Al—Ti—B4C system during casting", Composites Part A: Applied Science and Manufacturing, Elsevier Science Publishers B.V., Amsterdam, NL, vol. 37, No. 1, Jan. 1, 2006, pp. 133-138, XP028012879, ISSN: 1359-835X, DOI: 10.1016/J.COMPOSITESA.2005.03.011 [retrieved on Jan. 1, 2006].

Wang et al: "Characterization of in situ synthesized TiC particle reinforced Fe-based composite coatings produced by multi-pass overlapping GTAW melting process", Surface and Coatings Technology, Elsevier, Amsterdam, NL, vol. 201, No. 12, Feb. 2, 2007, pp. 5899-5905, XP005870201, ISSN: 0257-8972, DOI: 10.1016/J.SURFCOAT.2006.10.042.

Das K et al: "A Review on the Various Synthesis Routes of TiC Reinforced Ferrous Based Composites", Journal of Materials Science, Springer Netherlands, NL, vol. 37, No. 18, Sep. 15, 2002, pp. 3881-3892, XP002529651, ISSN: 0022-2461, DOI: 10.1023/A:1019699205003.

Jiang Q C et al: "In situ TiC-reinforced steel composite fabricated via self-propagating high-temperature synthesis of Ni—Ti—C system", Materials Letters, North Holland Publishing Company. Amsterdam, NL, vol. 59, No. 16, Jul. 1, 2005, pp. 2043-2047, XP027745216, ISSN: 0167-577X [retrieved on Jul. 1, 2005].

Zhiqiang Zhang et al: "Fabrication of TiC and TiB2 locally reinforced steel matrix composites using a Fe—Ti—B4C—C system by an SHS-casting route", Journal of Materials Science, Kluwer Academic Publishers, BO, vol. 42, No. 19, Jun. 22, 2007 , pp. 8350-8356, XP019528721, ISSN: 1573-4803, DOI: 10.1007/S10853-006-0764-6.

Das K et al: "Synthesis and characterization of austenitic Steel matrix composite reinforced with in-situ TiC particles", Journal of Materials Science, Kluwer Academic Publishers, BO, vol. 40, No. 18, Sep. 1, 2005, pp. 5007-5010, XP019210758, ISSN: 1573-4803, DOI: 10.1007/S10853-005-0923-1.

Dogan O N et al: "TiC-Reinforced Cast CR Steels", Journal of Materials Engineering and Performance, ASM International, Materials Park, OH, US, vol. 15, No. 3, Jun. 1, 2006, pp. 320-327, XP001243723, ISSN: 1059-9495, DOI: 10.1361/105994906X108585.

International Search Report dated Nov. 22, 2013 from International Application PCT/EP2013/069047 to Tata Steel Nederland Technology BV filed Sep. 13, 2013.

Introduction to Steels and Cast irons, Table 1.1 entitled Essential and Incidental elements in Steel and Cast Iron, ASM, 2000.

Sep. 17, 2015, Office Action for U.S. Appl. No. 14/428,150, Cheng Liu et al. filed Mar. 13, 2015.

Steel material properties, SteelConstruction.info, URL: <http://www.steelconstruction.info/Steel_material_properties>, retrieved from the Internet Dec. 11, 2015.

What Does Elongation mean?, Stahlbecker, URL : < http://stahlbecker.com/en/technical-characteristics/what-does-elongation-mean >, retrieved from the Internet Dec. 11, 2015.

H.W. Gillett, High Silicon Structural Steel, Dept. of Commerce Bureau of Standards, Technological Papers of the Bureau of Standards, No. 331, Nov. 1, 1926.

Electrical Steel, Wikipedia, URL : < https://en.wikipedia.org/wiki/Electrical_steel >, retrieved from the Internet Dec. 22, 2015.

Density of the Elements, URL: <http://periodictable.com/Properties/A/Density.al.html>, retrieved from the Internet Dec. 11, 2015.

Austenite, Wikipedia, URL: <https://en.wikipedia.org/wiki/Austenite>, retrieved from the Internet Dec. 5, 2015.

Ferrite, Wikipedia, URL: <https://en.wikipedia.org/wiki/Ferrite_(iron) >, retrieved from the Internet Dec. 5, 2015.

Correlation of Microstructure and Cracking Phenomenon Occurring during Hot Rolling of Lightweight Steel Plates, Shin et al, Metallurgical and Materials Transactions A, The Minerals, Metal & Materials Society and ASM Int'l, Jan. 2010, vol. 41, Issue 1, pp. 138-148, First online: Oct. 30, 2009.

* cited by examiner

HIGH STRENGTH AND LOW DENSITY PARTICLE-REINFORCED STEEL WITH IMPROVED E-MODULUS AND METHOD FOR PRODUCING SAID STEEL

CROSS-REFERENCE TO RELATED APPLICATIONS

This is a §371 US National Stage Application of International Application No. PCT/EP2013/069047 filed on Sep. 13, 2013, claiming the priority of European Patent Application No. 12184460.9 filed on Sep. 14, 2012.

FIELD OF THE INVENTION

The invention relates to a particle-reinforced high strength and low density steel and method for producing said steel.

BACKGROUND OF THE INVENTION

In the continuing efforts to reduce the carbon emissions of vehicles the steel industry, together with the car manufacturers, continue to strive to steels which allow weight reduction without affecting the processability of the steels and the safety of the finished product. To meet future $CO_2$-emission requirements, the fuel consumption of automobiles has to be reduced. One way towards this reduction is to lower the weight of the car body. A steel with a low density and high strength can contribute to this. At the same thickness, the use of a low density steel reduces the weight of car components. A problem with known high strength steels is that their high strength compromises the formability of the material during forming of the sheet into a car component.

Ordinary high strength steels, for example dual phase steels, allow use of thinner sheets and therefore weight reduction. However, a thinner part will have a negative effect on other properties such as stiffness, crash—and dent resistance. These negative effects can only be solved by increasing the steel thickness, thus negating the effect of the downgauging, or by changing the geometry of the component which is also undesirable.

In U.S. Pat. No. 6,383,662B1 US2010/0300585 low density steel is proposed based on addition of large amount of the light element of aluminium between 6 and 10%. However, the addition of the large quantity of Al has a negative impact on the elasticity modulus (E-modulus). To meet the stiffness requirements of auto body structures, a low elastic modulus of steel has to be compensated by increasing the gauge of the steel. This increases the weight of the part and thereby the weight reduction potential of this type of steel. A known way to increase the modulus of elasticity and reduce the density of steel is by incorporating ceramic particles of different natures, such as carbides, nitrides, oxides or borides. These particles have a much higher elastic modulus, ranging from about 300 to 550 GPa, than that of the steel base which has an E-modulus of around 205-210 GPa.

Powder metallurgy is normally used to introduce these ceramic particles uniformly distributed in a matrix of steel. Despite providing improved mechanical properties in comparison with conventional steels containing no dispersion of ceramic particles, powder metallurgy has severe practical and financial restrictions.

Reactions of the metal powders are difficult to prevent because of the high surface area of the metal powders. Even after compacting and sintering, there may be residual porosity that may play a role in inducing fracture during cyclic loading. Uniform distribution of the particles in the matrix is difficult to achieve. Moreover the chemical composition of interfaces matrix/particle, and therefore their cohesion is difficult to control because of the surface contamination of the powders before sintering. In addition, the cost of the process like power metallurgy is very high. Powder metallurgy process is therefore not economic for production on the scale required for the automotive and construction industry.

SUMMARY OF THE INVENTION

It is an object of this invention to provide a particle-reinforced high strength and low density steel with E-modulus comparable with conventional steel.

It is also an object of this invention to provide a method of mass producing the particle-reinforced steel product of the invention in an economical way.

It is also an object of this invention to provide a method of mass producing the particle-reinforced steel product of the invention without using powder metallurgy techniques to introduce the particles.

DETAILED DESCRIPTION OF THE INVENTION

One or more of these objects can be reached by providing a particle reinforced steel strip or sheet comprising, in weight percent, from 0.001 to 0.4% C
from 3 to 9% Al;
from 1.5 to 7% Ti
from 0.6 to 3.5% B
up to 5.0% Mn;
up to 1% Cr
up to 1% Ni;
up to 1% Mo;
up to 1% Cu
up to 0.5% Si;
up to 0.040% N;
up to 0.2% Nb;
up to 0.2% V;
up to 0.01% S;
up to 0.1% P;
remainder iron and inevitable impurities;

wherein the structure of the steel comprises at least 3 wt % of $\Sigma$ ($TiB_2$+$Fe_2B$+TiC)-particles, and wherein $-0.5<=(Ti-2.22*B)<=1.6$.

The steel matrix in which the (TiC+$Fe_2B$+$TiB_2$)-particles are embedded comprises, or consists of, ferrite and/or austenite.

All compositional percentages are in weight percent (wt. %) unless otherwise indicated. The unavoidable impurities are elements unavoidably contained in the steel due to circumstances such as raw materials, manufacturing facilities, etc.

Carbon is an important element for controlling the amount and stability of austenite and for forming TiC-particles that increases the E-modulus of the steel.

Aluminium is an essential element for the steel concept for achieving low density. Below 3%, the density reduction is insufficient and above 9% the ductility and processability is adversely affected Manganese contributes to the strengthening of the matrix by solid solution and is an austenite stabilizer. Mn can be used to control the amount and stability of austenite phase which is beneficial for ductility and formability. Manganese is also effective in binding sulphur thereby reducing the risk of hot-cracking during hot rolling. A suitable minimum manganese content is 0.1%.

Titanium is an important element for forming $TiB_2$- and TiC-particles that raise the E-modulus of the steel and reduce the density of the steel. The levels of Ti should be such that the volume fraction of Σ ($TiC+Fe_2B+TiB_2$)-particles is at least 3 wt. %. A suitable maximum amount is 20% wt. Σ ($TiC+Fe_2B+TiB_2$)-particles. In an embodiment the titanium content is 2%.

Boron is an important element for forming $TiB_2$- and $Fe_2B$-particles that raise the E-modulus of the steel. The levels of B should be such that the volume fraction of Σ ($TiB_2+Fe_2B+TiC$)-particles is at least 3 wt. %. A suitable maximum amount is 20% wt. Σ ($TiB_2+Fe_2B+TiC$)-particles. In an embodiment the boron content is at least 1%.

Nitrogen is an impurity element that consumes Ti to form TiN and should be kept as low as possible. Although the maximum allowable nitrogen content is 0.040% (400 ppm), the nitrogen should preferably be controlled below 0.020%.

Steel according to any one of the preceding claims wherein the specific density of the steel is between 6600 and 7300 $kgm^3$.

The steel is preferably calcium treated. The chemical composition may therefore also contain calcium in an amount consistent with a calcium treatment.

In an embodiment the precipitates have an average size of below 10 μm. preferably the average size is below 5 μm.

In an embodiment the aluminium content at most 8.5% and or at least 4.0%.

According to a second aspect, a method for producing a high strength and low density steel strip is provided comprising the steps of:

providing a steel slab or thick strip by:
- continuous casting, or
- by thin slab casting, or
- by belt casting, or
- by strip casting;

optionally followed by reheating the steel slab or strip at a reheating temperature of at most 1250° C.;

hot rolling the slab or thick strip and finishing the hot-rolling process at a hot rolling finishing temperature of at least 850° C.;

coiling the hot-rolled strip at a coiling temperature of between 500 and 750° C.

According to this method the steel according to the invention can be mass produced using conventional steel making equipment. The steel melt from which the steel according to the invention is made by using Ferro-alloys, and not by powder metallurgy. The particles are formed from the constituents of the steel melt and not by introducing them as powders into the steel melt. This makes the steel much easier to produce in mass, and thereby more economically. Preferably the reheating temperature is at most 1200° C.

In preferable embodiment the coiling temperature is at least 600° C. and/or the hot rolling finishing temperature is at least 900° C.

This hot-rolled strip can be optionally processed in a process comprising the steps of:

recrystallisation annealing in a continuous annealing process at a peak metal temperature of between 800 and 1000° C. or in a batch annealing process at a top temperature between 700 and 850° C.;

optionally galvanising the annealed strip in a hot-dip galvanising or electro-galvanising or a heat-to-coat process.

This hot-rolled strip can be subsequently further processed in a process comprising the steps of:

cold-rolling the hot-rolled strip at a cold-rolling reduction of from 40 to 90% to produce a cold-rolled strip;

annealing the cold-rolled strip in a continuous annealing process at a peak metal temperature of between 700 and 900° C. or in a batch annealing process at a top temperature between 650 and 800° C.;

optionally galvanising the annealed strip in a hot-dip galvanising or electro-galvanising or a heat-to-coat process.

The steel (cold-rolled or hot-rolled) may also be provided with a metallic coating to increase its corrosion resistance. This metallic coating preferably is a zinc or zinc alloy coating, and wherein the coating is applied by electrocoating or hot-dipping. The alloying elements in the zinc alloy coating may be aluminium, magnesium or other elements. An example of a suitable coating is the MAGIZINC® zinc alloy coating developed by Tata Steel.

The hot-rolled strip is usually pickled and cleaned prior to the cold-rolling step. In an embodiment the peak metal temperature in the continuous annealing process is at least 750° C., preferably at least 800° C.

In an Embodiment the Cold Rolling Reduction is at Least 50%.

In an embodiment the thickness of the cold-rolled strip is between 0.4 and 2 mm.

According to a third aspect the steel according to the invention is used in static constructions such as sections, bridges or bridge parts, buildings, in vehicles such as cars, yellow goods, trucks, or aerospace applications. In automotive applications such as vehicles this type of steel can be applied for example in brakes, suspension components, shock mounts, roof bows, and vehicle floors. In aerospace applications one of the possible applications are gears and bearings etc., in construction the structural steels for sections. For yellow goods the possible applications are e.g. boom and bucket arm structures on backhoes and excavators.

The invention is now further explained by means of the following, non-limiting example.

Steels were produced and processed into cold-rolled steel sheets having a thickness of 1 mm. The hot rolled strip had a thickness of 3.0 mm. The chemical composition of the steels is given in Table 1.

TABLE 1

Chemical composition in wt. % (I = invention, R = reference, tr = trace, inevitable impurity).

| Steel | C | Al | Ti | B | Mn | Si | N | P | S | |
|---|---|---|---|---|---|---|---|---|---|---|
| 1 | 0.0025 | 7.0 | 5.4 | 2.4 | 0.22 | 0.10 | 0.004 | tr. | tr. | I |
| 2 | 0.004 | 6.81 | tr. | tr. | 0.22 | 0.10 | 0.003 | tr. | tr. | R |
| 3 | 0.019 | 6.76 | 1.64 | 0.72 | 0.22 | 0.10. | 0.0006 | tr. | tr. | I |
| 4 | 0.041 | 6.75 | 6.10 | 2.68 | 0.23 | 0.10 | 0.003 | tr. | tr. | I |

In Tables 2 and 3 YLD means Yield Strength, UTS means Ultimate Tensile Strength, A80 means Elongation, A50 means Elongation, and E means Elasticity Modulus.

The steels were produced by casting a slab and reheating the slab at a temperature of at most 1250° C. This temperature is the maximum temperature, because at higher reheating temperatures excessive grain growth may occur. The reheating temperature employed for steel 3 was 1175° C. and for steel 4 was 1050° C. The finishing temperature during hot rolling was 900° C., coiling temperature 700° C., followed by pickling and cold rolling (67%) and continuous annealing at a peak metal temperature of 850° C. and hot-dip-galvanising. For steel 3 the annealing temperature was 860° C.

TABLE 2

Mechanical properties of hot rolled sheet (in RD)

| steel | YLD (MPa) | UTS (MPa) | A80 (%) | E (RD) (GPa) | Density (kg/m$^3$) | Particles (wt. %) |
|---|---|---|---|---|---|---|
| 1 | 385 | 665 | na | 200 | 6940 | 7.7 |
| 2 | 351 | 470 | 30 | 163 | 7260 | tr. |
| 3 | 406 | 609 | 20 (A50) | 194 | 7050 | 3.7 |
| 4 | 480 | 680 | 15 | 211 | 6710 | 8.8 |

(na = not available)

Figure 3:
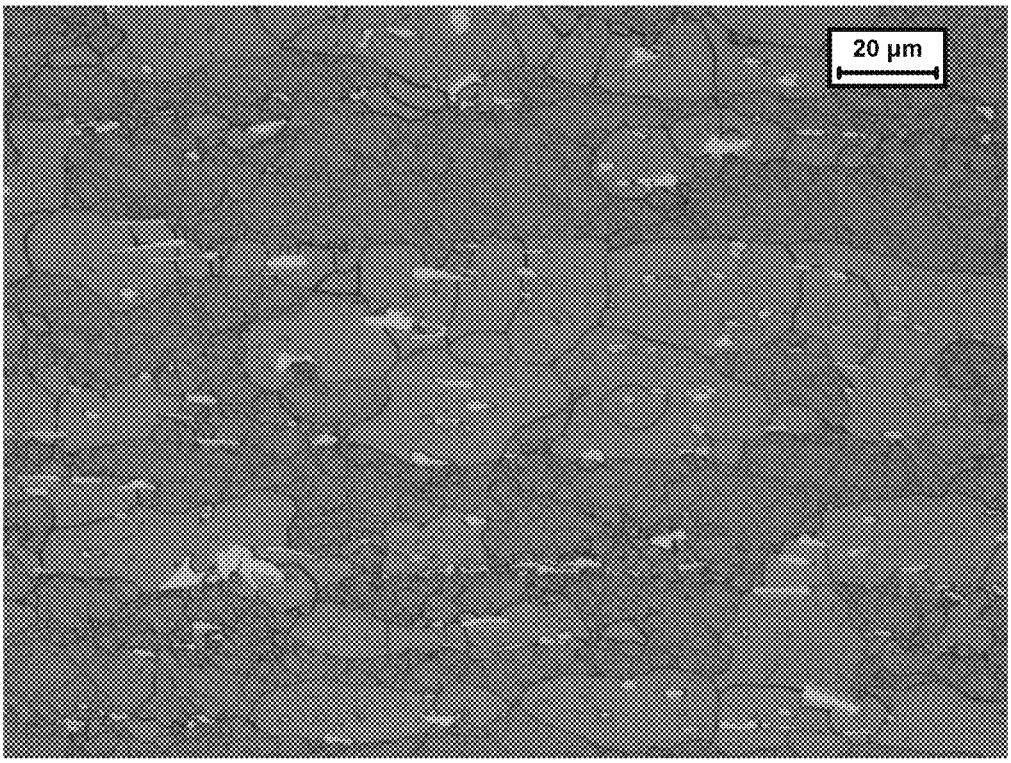
Figure 4:
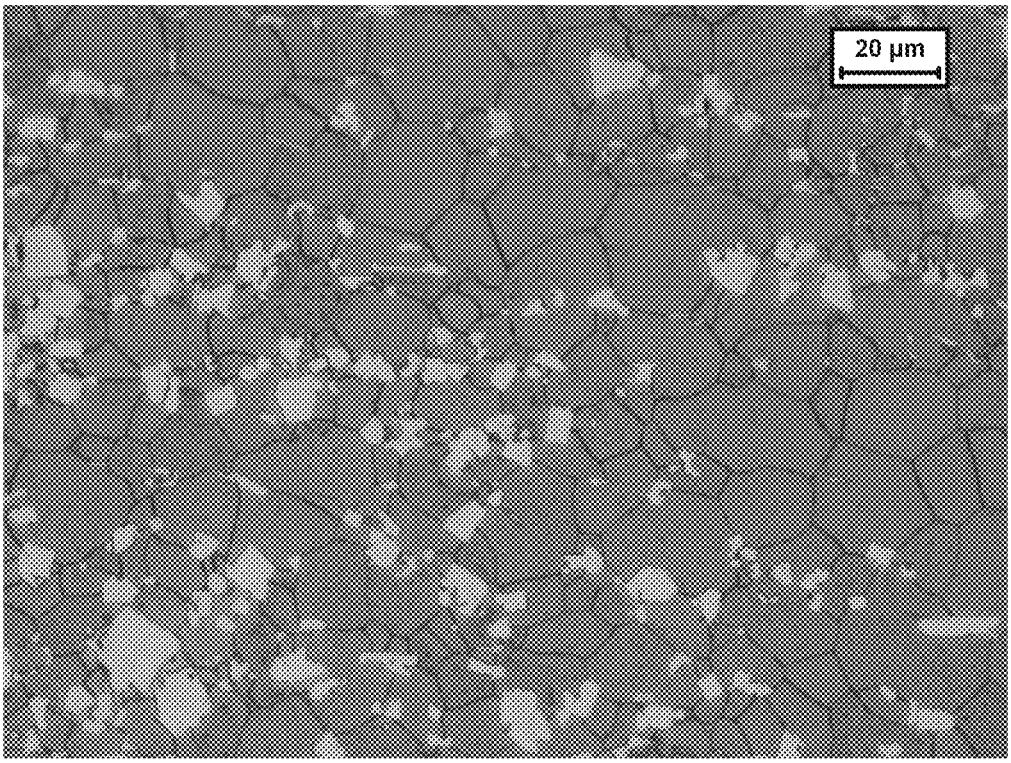

FIG. 1 to 4 shows micrographs of samples 3 and 4 in the as-cast (FIGS. 1 and 2) and hot-rolled condition (FIGS. 3 and 4).

TABLE 3

Mechanical properties of cold rolled and annealed sheet

| steel | YLD (MPa) | UTS (MPa) | Elongation (%) | E (RD) (GPa) | Density (kg/m$^3$) |
|---|---|---|---|---|---|
| 1 | 380 | 655 | na | 195 | 6940 |
| 2 | 345 | 465 | 30 (A80) | 162 | 7260 |
| 3 | 498 | 645 | 25 (A50) | 188 | 7050 |
| 4 | 510 | 685 | 14 (A50) | 202 | 6710 |

Figure 5:
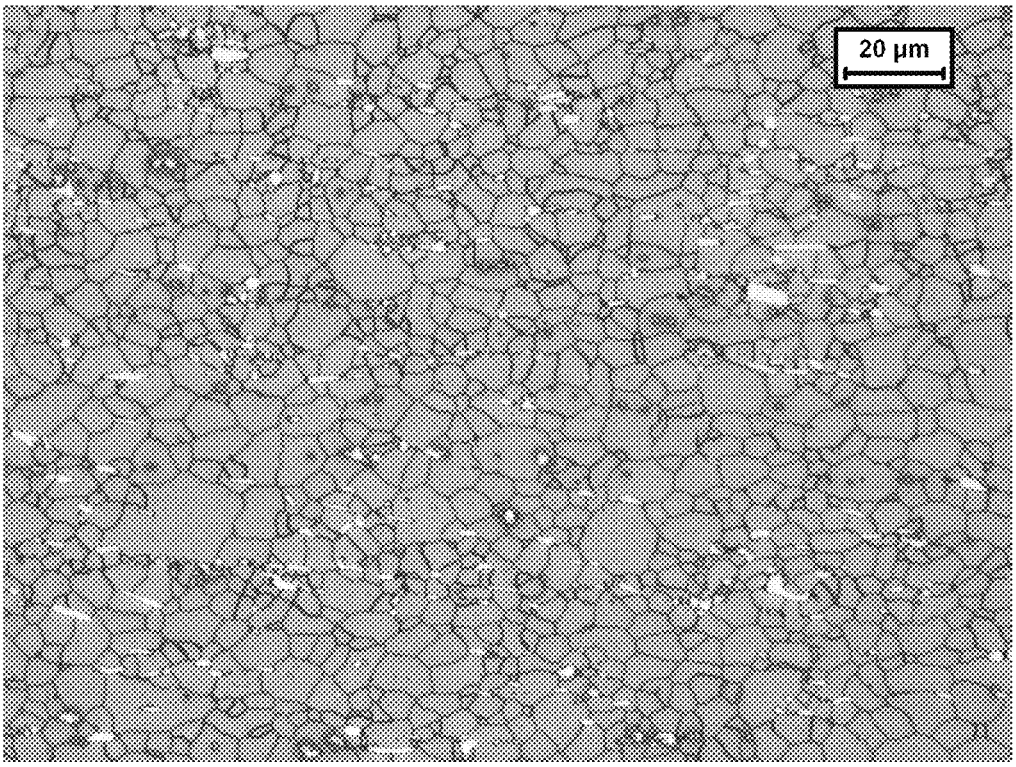

FIG. 5 shows a micrograph of sample 3 in the cold-rolled and recrystallisation annealed condition.

The invention claimed is:

1. A particle-reinforced steel strip or sheet comprising, in weight percent, from 0.001 to 0.4% C
from 3 to 9% Al
from 1.5 to 7% Ti
from 0.6 to 3.5% B
up to 5.0% Mn
up to 1% Cr
up to 1% Ni
up to 1% Mo
up to 1% Cu
up to 0.5% Si
up to 0.040% N
up to 0.2% Nb
up to 0.2% V
up to 0.01% S
up to 0.1% P
remainder iron and inevitable impurities;

wherein the structure of the steel comprises at least 3 wt % of $\Sigma(TiB_2+Fe_2B+TiC)$-particles, and wherein $-0.5 \leq (Ti-2.22*B) \leq 1.6$.

2. The steel strip or sheet according to claim 1, wherein Ti is at least 2.0% and/or B is at least 1.0%.

3. The steel strip or sheet according to claim 1, wherein Al is at least 4.0% and/or at most 8.5%.

4. The steel strip or sheet according to claim 1, wherein the specific density of the steel is between 6700 and 7300 kg/m$^3$.

5. The steel strip or sheet according to claim 1, wherein the steel is a hot-rolled steel sheet.

6. The steel strip or sheet according to claim 1, wherein the steel is a cold-rolled steel sheet.

7. The steel strip or sheet according to claim 1, wherein the matrix in which the $(TiC+Fe_2B+TiB_2)$-particles are embedded comprises ferrite and/or austenite.

8. The steel strip or sheet according to claim 1, wherein the matrix in which the $(TiC+Fe_2B+TiB_2)$-particles are embedded consists of ferrite and/or austenite.

9. The steel strip or sheet according to claim 1, wherein the matrix in which the $(TiC+Fe_2B+TiB_2)$-particles are embedded comprises austenite.

10. The steel strip or sheet according to claim 1, wherein Ti is 1.5 to 2.0%.

11. The steel strip or sheet according to claim 1, wherein Al is 3 to 4.0%.

12. The steel strip or sheet according to claim 1, further comprising a metallic coating.

13. The steel strip or sheet according to claim 1, further comprising a zinc or zinc alloy metallic coating.

14. The steel strip or sheet according to claim 1, comprising from 0.001 to 0.041% C.

15. The steel strip or sheet according to claim 1, having a minimum Ultimate Tensile Strength (UTS) of 609 MPa.

16. A steel part produced from the steel strip or sheet according to claim 1 for use in static constructions, vehicles, aerospace applications and other engineering applications.

17. The steel part according to claim 16, for use in a vehicle selected from the group consisting of cars, yellow goods, and trucks.

18. A method for producing a particle-reinforced steel strip or sheet according to claim 1 comprising the steps of:

providing a steel slab or thick strip, optionally calcium treated, by:
continuous casting, or
by thin slab casting, or
by belt casting, or
by strip casting;

optionally followed by reheating the steel slab or strip at a reheating temperature of at most 1250° C.;

hot rolling the slab or thick strip and finishing the hot-rolling process at a hot rolling finishing temperature of at least 850° C.;

coiling the hot-rolled strip at a coiling temperature of between 500 and 750° C.

19. The method according to claim 18, wherein the hot-rolled strip is reheated in:

a continuous annealing step, optionally followed by hot-dip galvanising followed by fast cooling, or a heat-to-coat step, followed by hot-dip galvanising and fast cooling.

20. The method according to claim 18, comprising cold-rolling the hot-rolled steel strip at a cold-rolling reduction of from 40 to 90% to produce a cold-rolled strip;

annealing the cold-rolled strip in a continuous annealing process with a peak metal temperature of between 700 and 900° C. or in a batch annealing process at a top temperature between 650 and 850° C.;

optionally galvanising the annealed strip in a hot-dip galvanising or electro-galvanising or a heat-to-coat process.

21. The method according to claim 20, wherein the peak metal temperature in the continuous annealing process is at least 750° C.

22. The method according to claim 20, wherein the cold rolling reduction is at least 50%, and/or the thickness of the cold-rolled strip is between 0.4 and 2 mm.

23. The method according to claim 18, wherein the steel melt is produced by using Ferro-alloys and not by powder metallurgy.

24. The method according to claim 20, wherein the peak metal temperature in the continuous annealing process is at least 800° C.

* * * * *